US010052792B2

(12) United States Patent
Bruins et al.

(10) Patent No.: US 10,052,792 B2
(45) Date of Patent: Aug. 21, 2018

(54) METHOD AND SYSTEM FOR CONTROL OF AN AXIAL SKINNING APPARATUS

(71) Applicant: Corning Incorporated, Corning, NY (US)

(72) Inventors: Derik Alan Bruins, Elmira, NY (US); Thomas Richard Chapman, Painted Post, NY (US); Ralph Henry Hagg, Corning, NY (US); Parasuram Padmanabhan Harihara, Painted Post, NY (US); Yihong Mauro, Corning, NY (US)

(73) Assignee: Corning Incorporated, Corning, NY (US)

( * ) Notice: Subject to any disclaimer, the term of this patent is extended or adjusted under 35 U.S.C. 154(b) by 0 days.

(21) Appl. No.: 14/890,627

(22) PCT Filed: May 21, 2014

(86) PCT No.: PCT/US2014/038901

§ 371 (c)(1),
(2) Date: Nov. 12, 2015

(87) PCT Pub. No.: WO2014/193707

PCT Pub. Date: Dec. 4, 2014

(65) Prior Publication Data

US 2016/0082618 A1 Mar. 24, 2016

Related U.S. Application Data

(60) Provisional application No. 61/828,363, filed on May 29, 2013.

(51) Int. Cl.
*B28B 17/00* (2006.01)
*B28B 19/00* (2006.01)

(52) U.S. Cl.
CPC ..... *B28B 19/0038* (2013.01); *B28B 17/0081* (2013.01)

(58) Field of Classification Search
CPC ..... B28B 17/0081; B28B 19/0038
(Continued)

(56) References Cited

U.S. PATENT DOCUMENTS 4,416,043 A 11/1983 Aoki et al.
6,551,535 B2 4/2003 Sander
(Continued)

FOREIGN PATENT DOCUMENTS

CN 1883908 12/2006
CN 101213036 7/2008
(Continued)

OTHER PUBLICATIONS

International Search Report, issued in connection with corresponding PCT application No. PCT/US2014/038901, dated Aug. 6, 2014.
(Continued)

*Primary Examiner* — Alexander M Weddle
(74) *Attorney, Agent, or Firm* — Joseph M. Homa

(57) ABSTRACT

A control system for an axial skinning apparatus (100), including: •a force to cause a ceramic honeycomb part (110) to pass through the skinning apparatus (100); •a force that urges flowable cement on to the ceramic honeycomb part (110); •a sensor to detect the force on the cement; •a sensor to detect the force on the ceramic part; and •a controller (300) which receives: •a signal from the sensor on the flowable cement, •a signal from the sensor on the ceramic part (110), or both, and the controller (300) controls the pressure set point (310) of the cement source based on one or both of the received signals, and the controller (300) adjusts control parameters using feedback control and
(Continued)

pseudo feed forward control. A method of using the axial skinning apparatus (100) is also disclosed.

8 Claims, 8 Drawing Sheets

(58) Field of Classification Search
USPC ..... 118/708; 427/8
See application file for complete search history.

(56) References Cited

U.S. PATENT DOCUMENTS

| | | | |
|---|---|---|---|
| 8,439,299 | B2 | 5/2013 | Luo et al. |
| 9,132,578 | B2 | 9/2015 | Anthony et al. |
| 9,138,674 | B2 | 9/2015 | Takahashi et al. |
| 2002/0006471 | A1 | 1/2002 | Ohira et al. |
| 2002/0100994 | A1* | 8/2002 | Sander ..... B28B 19/0038 264/102 |
| 2004/0238158 | A1 | 12/2004 | Vandermeer et al. |
| 2009/0011178 | A1 | 1/2009 | Masukawa et al. |
| 2009/0220735 | A1 | 9/2009 | Mizuno et al. |
| 2011/0237431 | A1 | 9/2011 | Ambrosini et al. |
| 2012/0064254 | A1 | 3/2012 | Franchet et al. |

FOREIGN PATENT DOCUMENTS

| | | | |
|---|---|---|---|
| CN | 202137837 | U | 2/2012 |
| EP | 0554104 | A2 | 8/1993 |
| EP | 1738815 | | 1/2007 |
| FR | 2625941 | A1 | 7/1989 |
| JP | 60192823 | A | 10/1985 |
| JP | 61008164 | | 1/1986 |
| JP | 9314011 | A | 12/1997 |
| JP | 2007054740 | A | 3/2007 |
| JP | 2008119604 | | 5/2008 |
| JP | 2010005869 | A | 1/2010 |
| WO | 2006135452 | | 12/2006 |
| WO | 2011008461 | | 1/2011 |
| WO | 2013082061 | | 6/2013 |

OTHER PUBLICATIONS

A Tutorial on Feedforward Control, Reflections of a Process Control Practitioner, 2011, http://www.opticontrols.com/.

Malik, Rajeev, and Uday V. Shenoy. "Generalized annular Couette flow of a power-law fluid." Industrial & engineering chemistry research 30.8 (1991): 1950-1954.

Nyco NYAD® G Wollastonite Information, 2015, pp. 1-2, http://www.matweb.com/search/datasheet, downloaded Jan. 21, 2015.

Fused Silica Material Properties, Pamphlet, www.accuratus.com.

International Preliminary Report on Patentability, issued in connection with corresponding PCT application No. PCT/US2014/038901, dated Dec. 10, 2015.

English Translation of CN201480031117.4 Notice of First Office Action dated Sep. 19, 2016; 8 pages; Chinese Patent Office.

English Translation of JP2016516696 Office Action dated Feb. 6, 2018; 4 pages; Japanese Patent Office.

* cited by examiner 100
104
106
102
1A
1A
112
108
103
110

1B
1B
112
103
108
110
111

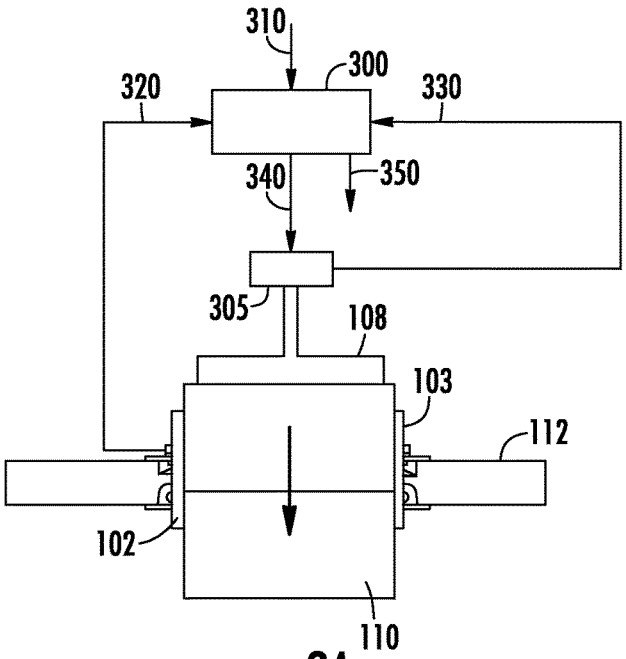
FIG. 2A
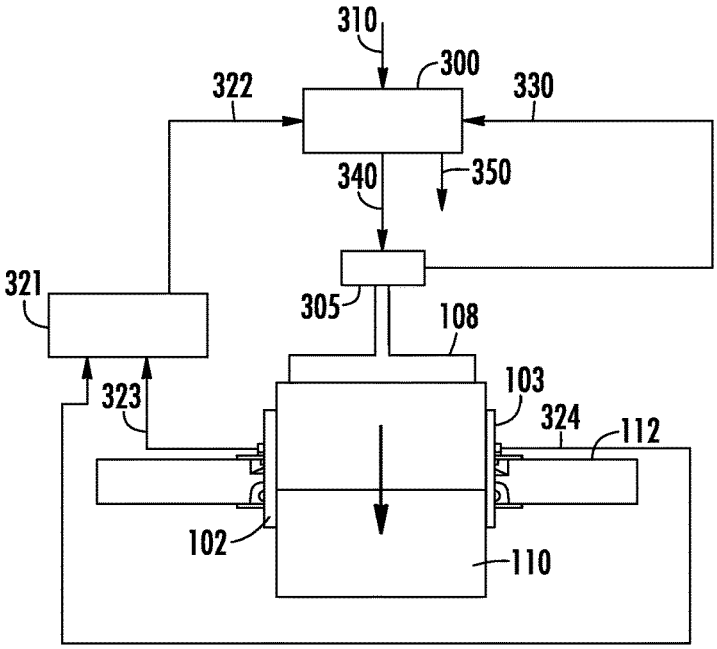
FIG. 2B
FIG. 2

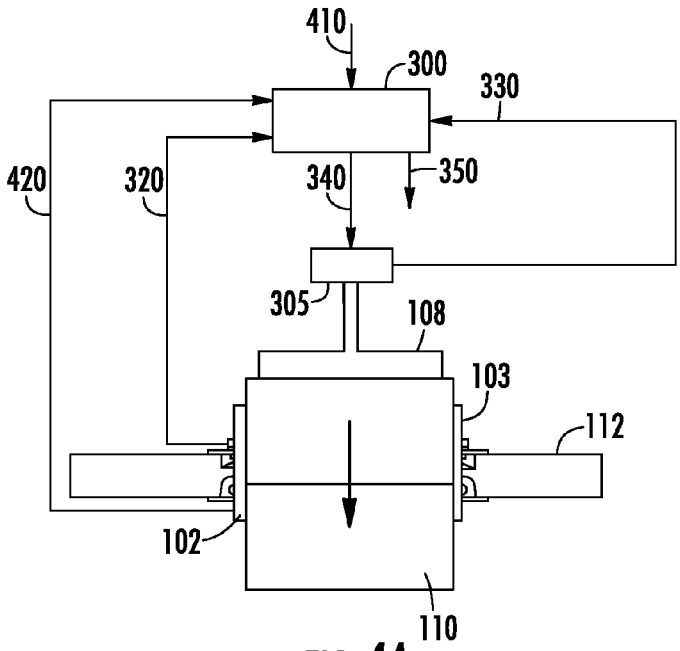
FIG. 4A
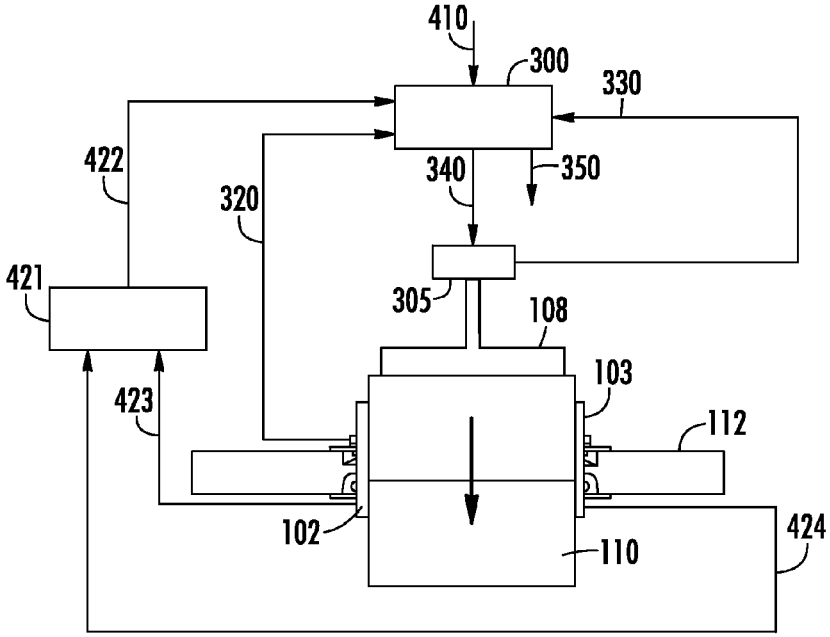
FIG. 4B
FIG. 4

METHOD AND SYSTEM FOR CONTROL OF AN AXIAL SKINNING APPARATUS

This application claims the benefit of priority to U.S. Application No. 61/828,363 filed May 29, 2013 the content of which is incorporated herein by reference in its entirety.

The entire disclosure of any publication or patent document mentioned herein is incorporated by reference.

CROSS-REFERENCE TO RELATED APPLICATIONS

This application is related to commonly owned and assigned U.S. Provisional Patent Application 61/564,395, filed on Nov. 29, 2011, now U.S. patent application Ser. No. 13/463,125, filed on Mar. 17, 2011, entitled "Apparatus And Method For Skinning Articles," the content of which is relied upon and incorporated herein by reference in its entirety, but does not claim priority thereto.

BACKGROUND

The disclosure relates to a control method and system to control an axial skinning process to achieve a high quality and defect free skinned ceramic parts.

SUMMARY

In embodiments, the disclosure provides a pseudo feed-forward augmented feedback control method and system to efficiently control the axial skinning process to achieve a high quality and defect free skinned ceramic parts.

BRIEF DESCRIPTION OF THE FIGURES

In embodiments of the disclosure:

FIGS. 2A and 2B show, respectively, a cross-sectional schematic of one embodiment of the axial skinning process control architecture (2A); and cross-sectional schematic of another embedment of the axial skinning process control architecture (2B).

FIGS. 4A and 4B show, respectively, a cross-sectional schematic of another embodiment of the axial skinning process control architecture; and a cross-sectional schematic of yet another embodiment of the axial skinning process control architecture.

DETAILED DESCRIPTION

Figures 1, 1A, 1B:
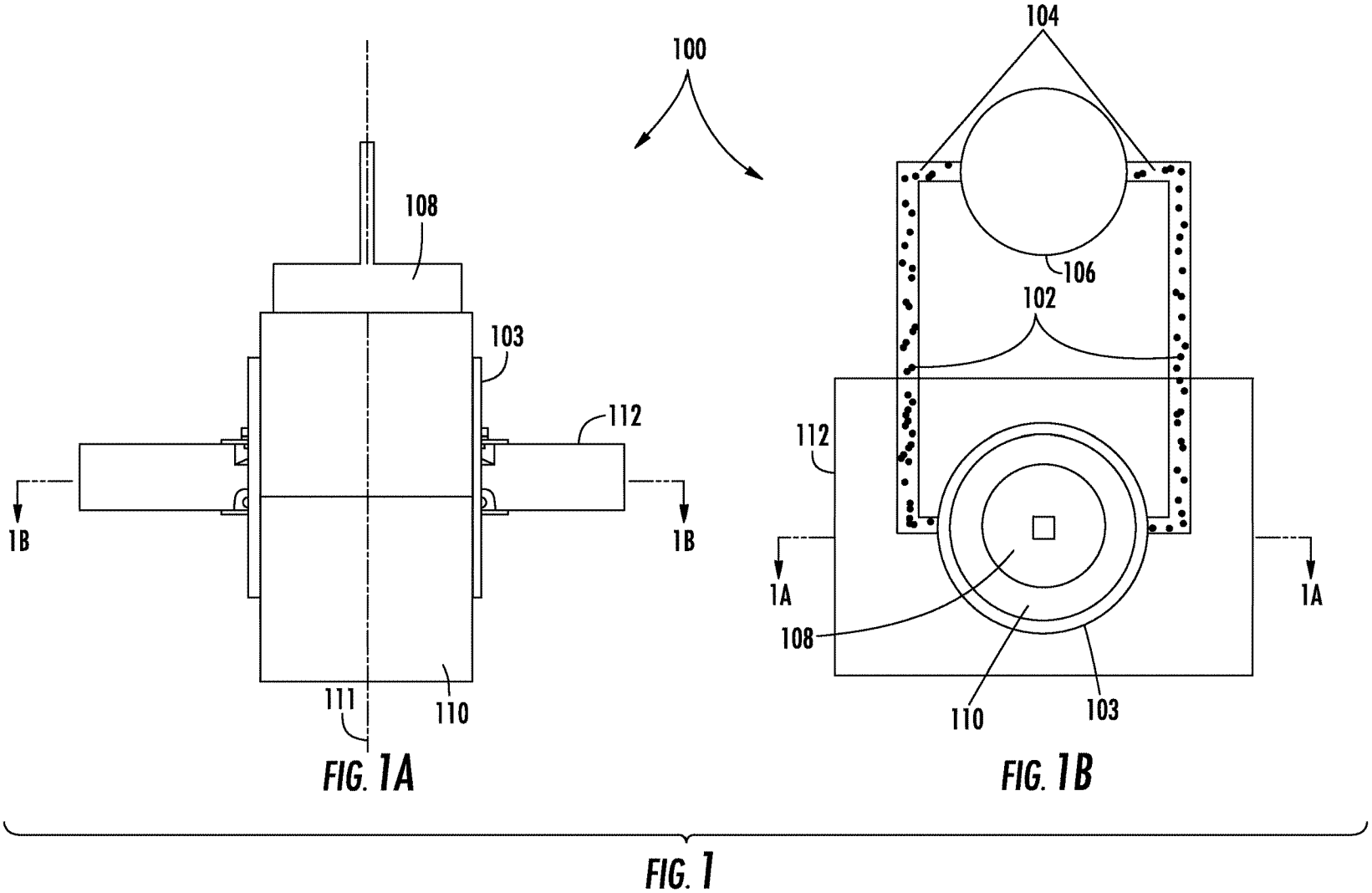
FIGS. 1A and 1B show, respectively, cross-sectional schematics of an exemplary skinner apparatus (100).

Various embodiments of the disclosure will be described in detail with reference to drawings, if any. Reference to various embodiments does not limit the scope of the invention, which is limited only by the scope of the claims attached hereto. Additionally, any examples set forth in this specification are not limiting and merely set forth some of the many possible embodiments of the claimed invention.

In embodiments, the disclosed apparatus or system, and the disclosed method of using the apparatus for skinning ceramic parts provide one or more advantageous features or aspects, including for example as discussed below. Features or aspects recited in any of the claims are generally applicable to all facets of the invention. Any recited single or multiple feature or aspect in any one claim can be combined or permuted with any other recited feature or aspect in any other claim or claims.

"Unipipe" refers to a central structure of the apparatus that is adapted to receive an unskinned ceramic part and further adapted to receive flowable cement from a cement source and to deliver the cement to the surface of the unskinned part within the unipipe to produce the skinned part.

"Tailpipe" refers to the out bound or exit portion of the unipipe and where the part is bearing skin.

"Include," "includes," or like terms means"encompassing but not limited to", that is, inclusive and not exclusive.

"About" modifying, for example, the quantity of an ingredient in a composition, concentrations, volumes, process temperature, process time, yields, flow rates, pressures, viscosities, and like values, and ranges thereof, employed in describing the embodiments of the disclosure, refers to variation in the numerical quantity that can occur, for example: through typical measuring and handling procedures used for preparing materials, compositions, composites, concentrates, or use formulations; through inadvertent error in these procedures; through differences in the manufacture, source, or purity of starting materials or ingredients used to carry out the methods; and like considerations. The term "about" also encompasses amounts that differ due to aging of a composition or formulation with a particular initial concentration or mixture, and amounts that differ due to mixing or processing a composition or formulation with a particular initial concentration or mixture.

"Consisting essentially of" in embodiments can refer to, for example:

- a control system and apparatus used to make a skinned article as disclosed herein; and
- a method of making a skinned article using the disclosed control system and apparatus, as disclosed herein.

The apparatus for making the skinned article, the method of making a skinned article, the resulting skinned article, the compositions, or the formulations, of the disclosure can include the components or steps listed in the claim, plus other components or steps that do not materially affect the basic and novel properties of the compositions, articles, apparatus, or methods of making and use of the disclosure, such as particular compositions, particular additives or ingredients, a particular agent, a particular surface modifier or wetting agent or condition, or like structure, material, or process variable selected.

The indefinite article "a" or "an" and its corresponding definite article "the" as used herein means at least one, or one or more, unless specified otherwise.

Abbreviations, which are well known to one of ordinary skill in the art, may be used (e.g., "h" or "hr" for hour or hours, "g" or "gm" for gram(s), "mL" for milliliters, and "rt" for room temperature, "nm" for nanometers, and like abbreviations).

Specific and preferred values disclosed for components, ingredients, additives, times, temperatures, pressures, and like aspects, and ranges thereof, are for illustration only; they do not exclude other defined values or other values within defined ranges. The apparatus, and methods of the disclosure can include any value or any combination of the values, specific values, more specific values, and preferred values described herein.

Corning Incorporated makes substrate and filter articles that are used in heavy duty vehicles for after treatment emission control, and which control satisfies environmental regulations. One of the steps in the production of these heavy duty substrates and filters is the application of a cement based skin or outer wall on the outer peripheral axial surface of the substrates and filters. Some advantages of applying the skin include, for example, the skin adds to the aesthetic value of the product, the skin adds strength to the product for handling, and the skin aids in the product meeting some of the key attributes specified by the customer such as the isostatic strength. The application of a skin on the substrates and filters is a significant aspect in the production of these products.

Combined feed forward and feedback control systems have been described, see for example, "The Tutorial on Feedforward Control Notes" on-line at: blog.opticontrols.com/archives/297, and U.S. Pat. No. 8,439,299, issued May 14, 2013, to Luo, et al., entitled "Active cancellation and vibration isolation with feedback and feed forward control for an aircraft engine mount" mentions an engine mount structure is provided with active vibration mechanisms which are attached in the vicinity of the engine mount to prevent engine vibrations from propagating into the engine mounting structure, for example, the wing or fuselage structure of an aircraft. Additionally, sensors are provided on the engine and/or wing/fuselage structure to provide control signals to the active vibration mechanisms so that the active vibration mechanism react to the sensed data to minimize the vibration transmissibility from the engine into the wing/fuselage.

In embodiments, the axial skinning apparatus can include, for example: a manifold having:

- a chamber, one or more channels, or both, to receive a source of flowable cement and to direct the received flowable cement to an interior skinning region or skinning chamber surrounding at least a portion of the lateral surface of a first article received in the skinning chamber, and to form a cement skin on the lateral surface of the received article;
- a source of motive force to controllably urge the received article into and through the skinning chamber; and
- a support member to receive and support the resulting skinned article, see for example, the abovementioned commonly owned U.S. patent application Ser. No. 13/463,125.

In embodiments, the disclosure provides a control system for making, for example, ceramic parts having uniform skin properties in an axial skinning apparatus, comprising:

- at least one motive force, i.e., a motor and pusher/plunger combination, that provides relative motion to cause a ceramic honeycomb part to pass through the skinning chamber of the skinning apparatus;
- at least one motive force that urges flowable cement through the skinning apparatus and on to the axial outer surface of the ceramic honeycomb part;
- at least one first sensor to detect the motive force on the flowable cement (320);
- at least one second sensor to detect the motive force on the ceramic part (330); and
- a controller which receives:
- a signal from the at least one first sensor to detect the motive force on the flowable cement,
- a signal from the at least one second sensor to detect the motive force on the ceramic part, or both first and second sensor signals, and the controller controls the pressure set point of the cement source (310) based on the received signal from the at least one first sensor, the at least one second sensor, or both, and the controller is configured to adjust control parameters (340 and 350) using a combined feedback control and pseudo feed forward control.

The control parameters can be selected, for example, from at least one of: the velocity of the part, the tank pressure set point, or combinations thereof.

In embodiments, the control system can further comprise, for example, a filter for filtering the signal of at least one of: the manifold pressure feedback, the tailpipe pressure feedback, or combinations thereof.

In embodiments, the disclosure provides a method of controlling the batch skinning of ceramic parts in an the axial skinning apparatus as disclosed herein, comprising:

- sensing the at least one motive force (e.g., target manifold pressure, single point manifold pressure or filtered manifold pressure) acting on the flowable cement source (320) being delivered to the skinning chamber of the skinning apparatus and the ceramic honeycomb part;
- sensing the % Travel (330) of the ceramic honeycomb part traversing the skinning chamber of the apparatus;
- adjusting the at least one motive force (e.g., mechanical force or pressure) acting on the flowable cement source (350) or adjusting the at least one motive force acting on the part traversing the skinning chamber (340) based on the sensed motive force and the sensed % Travel to minimize skin defects in the resulting skinned ceramic part; and
- adjusting at least one control parameter (either or both 340 and 350) of the at least one motive force acting on the flowable cement source or at least one control parameter of the at least one motive force acting on the part based on a combined pseudo feedback and feed forward control.

In embodiments, the adjusting the at least one motive force acting on the flowable cement comprises adjusting the pressure of the flowable cement.

In embodiments, the at least one motive force acting on the flowable cement source comprises a nominal pressure comprised of at least one of: a target manifold pressure, a single point manifold pressure; a filtered manifold pressure, a single point tailpipe pressure, a filtered tailpipe pressure, or combinations thereof.

The axial skinning apparatus can accomplish batch or stepwise skinning using an indexed push dispense sequence.

In embodiments, the % Travel can be, for example, less than about 90% and greater that about 40%.

In embodiments, the ratio of $P_{Threshold}$ to $P_{set\ point\ manifold}$ can be, for example, less than about 0.8 and greater that about 0.5.

In embodiments, the method can further comprise filtering with a digital filter the signal of at least one of: the manifold pressure feedback, the tailpipe pressure feedback, or combinations thereof.

In embodiments, the method of controlling a batch skinning of ceramic parts in the abovementioned axial skinning apparatus, can include, for example:

- determining (i.e., sensing) the nominal velocity of a part traversing the skinning chamber of the apparatus;
- determining (i.e., sensing) the nominal pressure for the flowable cement;
- determining the exact time (i.e., proper moment or time interval) to start the skinning process for each part in the skinning process;
- adjusting at least one of: the nominal velocity of the traversing part, the nominal pressure acting on the flowable cement, the exact time to start skinning, or a combination thereof.

In embodiments, determining the exact time (i.e., proper moment or time interval) to start the skinning process for each part in the skinning process can include, for example:

- if Pmanifold or Ptailpipe is greater than Pthreshold, then "start the skinning process", wherein "start the skinning process" comprises moving the part in the apparatus and increasing the pressure on cement source.

In embodiments, the disclosure provides a feedback control scheme that uses real-time feedback from the axial skinning process to control key process variables that affect the final skin quality.

In embodiments, the disclosure provides a method that determines the nominal part velocity through the skinning process that achieves the desired product quality.

In embodiments, the disclosure provides a method to determine when exactly to start the skinning process for each product in a batch processing mode.

In embodiments, the disclosed method provides the correct amount of flowable cement material in the apparatus to the ceramic part to skin the part to achieve high material utilization rates and reduce defects.

In embodiments, the disclosure provides a feed-forward control scheme to account for skin material variations. This includes a model that describes the impact of skin material variations on the final skin quality and the significant process parameters.

In embodiments, the disclosure provides a method of obtaining uniform, repeatable cement pressure and part velocity profiles during axial skinning with index push process.

In embodiments, the disclosed axial skinning process addresses material utilization issues and increases the use rate, or yield of useable articles, by more than 40%, which provides significant cost savings. However, an efficient control scheme is preferred to be able to achieve the material utilization rate desired by reducing the defects on the final skinned part and also conserving the amount of material applied on the skin. The amount of the skin material applied is a significant aspect in achieving the high material utilization rates.

In embodiments, the disclosure provides an efficient control solution for the axial skinning process, which solution achieves high material utilization rates. The method uses process fundamentals and first principles modeling to correlate the final skin quality and significant process parameters. This understanding is then applied to the design of a feedback strategy to control the significant process parameters. A pseudo feed-forward control scheme is augmented to account for some of the skin material related variations that impact the significant process parameters.

In embodiments, the disclosed method can correlate primary process parameters, such as flowable cement pressure, the velocity of the part through the apparatus, to the final skin quality of the product. The disclosed method uses real-time feedback from the axial skinning process to control significant process parameters that affect the skin quality. A feature of the disclosure is a determination of the nominal part velocity through the skinning process. The speed of travel of the part through the axial skinning process and the pressure and velocity relationship play a significant role in reducing defects in the final skinned product. The method also determines when to start the skinning process for each part. The method also provides a proper amount of material to skin the part and to achieve high material utilization rates and reduce skin quality defects. Another feature of the disclosure is the ability to account for skin material variations. The variations are accounted for by incorporating a pseudo feed-forward scheme in conjunction with the feedback control scheme.

In embodiments, the disclosed system and method are advantaged at least as follows:

- reduction of defects in the final skinned product;
- efficiently controls the axial skinning process using real-time feedback from the process;
- provides the proper pressure-velocity relationship;
- increase in the material utilization rates;
- reduction of defects in the final skinned part leading to less ware (i.e., parts) waste;
- provides the proper amount of material used for skinning the part;
- compensation for skin material variations;
- the system and method can automatically or manually adjust for the variations in the skin material, such as flow rate, viscosity, and pressure, through the use of a pseudo feed-forward control scheme;
  - elimination of a process step;
  - the efficient control process results in the reduction of defects in the final skinned parts and eliminates a repair or finishing step;
  - defect reduction results in labor related cost savings; and
  - the process is easily transferable to other production lines;
  - the method is applicable to production lines that employ an axial skinning process; and the process is capable of working with existing control methods to provide enhanced benefits.

Referring to the figures, FIGS. 1A and 1B show, respectively, cross-sectional schematics of an exemplary skinner apparatus (100). Skin cement (102) is fed into a cylindrical tube (103) (also known as the unipipe) through feed pipes (104) from a pressure tank (106) maintained at the determined pressure set point. A pusher (108) is used to push the parts (110) through the unipipe (103) and the pusher (108) is electrically actuated. The manifold (112) serves two purposes. One purpose is to transiently hold the unipipe and a second purpose is to distribute the skin cement uniformly around the unipipe interior to ensure a uniform flow front to the outer surface of the captive part (110) having a vertical axis (111), being skinned. FIG. 1A is a vertical elevational cross section (at A-A of FIG. 1B), and FIG. 1B is a horizontal cross section (at B-B of FIG. 1A).

FIGS. 2A and 2B show cross-sectional schematics of embodiments of the axial skinning process control architecture. FIG. 2A includes: a controller (300), a manifold pressure set point (310); a manifold pressure feedback (320); a % travel (330) measure; a velocity (340) driving the relative motion of the part (110) and the skinning chamber (102) of the unipipe (103), such as for motor (305) and pusher (108) combination; and tank pressure set point (350)

to tank pressure controller. Flowable cement is supplied from a cement source (not shown) to, for example, manifold (112) and then to the skinning chamber annulus (102). FIG. 2B includes: a controller (300), a manifold pressure set point (310); a filtered manifold pressure feedback (322); a % travel (330) measure; a velocity (340) for driving the relative motion of the part (110) and the skinning chamber (102) of the unipipe (103), such as for motor (305) and pusher (108) combination; and tank pressure set point (350) to tank pressure controller; and additionally an electronic signal filter (321) that can receive the manifold pressure feedback signal (323), the manifold pressure feedback signal (324), or both signals.

Figure 3:
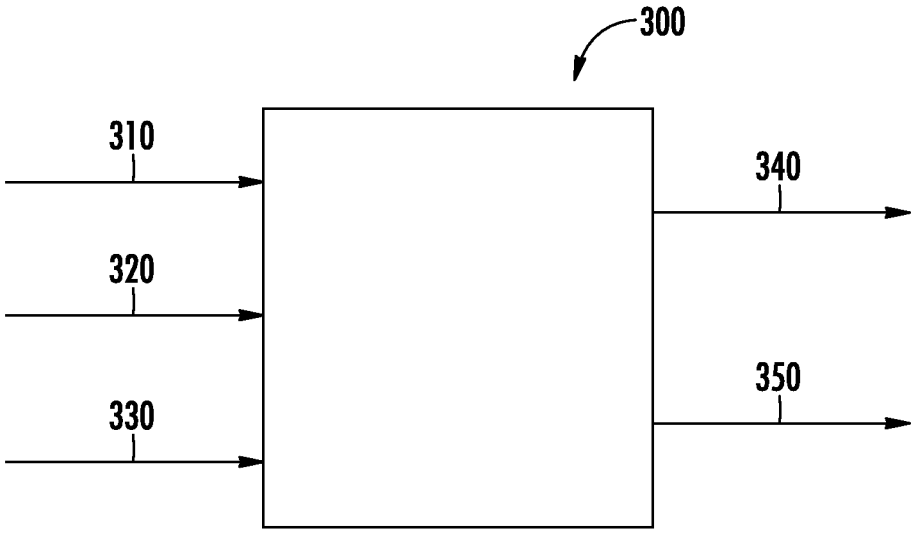
FIG. 3 shows a multi-input multi-output controller architecture (300) for the embodiments shown in FIGS. 2A and 2B.

FIG. 3 shows a multi-input multi-output controller architecture (300) for the embodiments shown in FIGS. 2A and 2B, illustrating the controller inputs and outputs, for example, inputs: target or set point manifold pressure (310); single point or filtered manifold pressure measurement (320); and a % travel (330) measure; and outputs: a part velocity (340) and a tank pressure set point (350).

FIGS. 4A and 4B show cross-sectional schematics of other embodiments of the axial skinning process control architecture. FIG. 4A includes: a controller (300), a tailpipe pressure set point (410); a manifold pressure feedback (320); a % travel (330) measure; a velocity (340) driving the relative motion of the part (110) and the skinning chamber (102) of the unipipe (103), such as for motor (305) and pusher (108) combination; and tank pressure set point (350) to tank pressure controller, and a tailpipe pressure feedback (420). Flowable cement is supplied from a cement source (not shown) to, for example, manifold (112) and then to the skinning chamber annulus (102). FIG. 4B includes: a controller (300), a tailpipe pressure set point (410); a manifold pressure feedback (320); a % travel (330) measure; a velocity (340) signal driving the relative motion of the part (110) and the skinning chamber (102) of the unipipe (103), such as for motor (305) and pusher (108) combination; and tank pressure set point (350) to tank pressure controller; a filtered tailpipe pressure feedback (422); and an electronic signal filter (421) that can receive the tailpipe pressure feedback signal (423), the tailpipe pressure feedback signal (424), or both signals.

Figure 5:
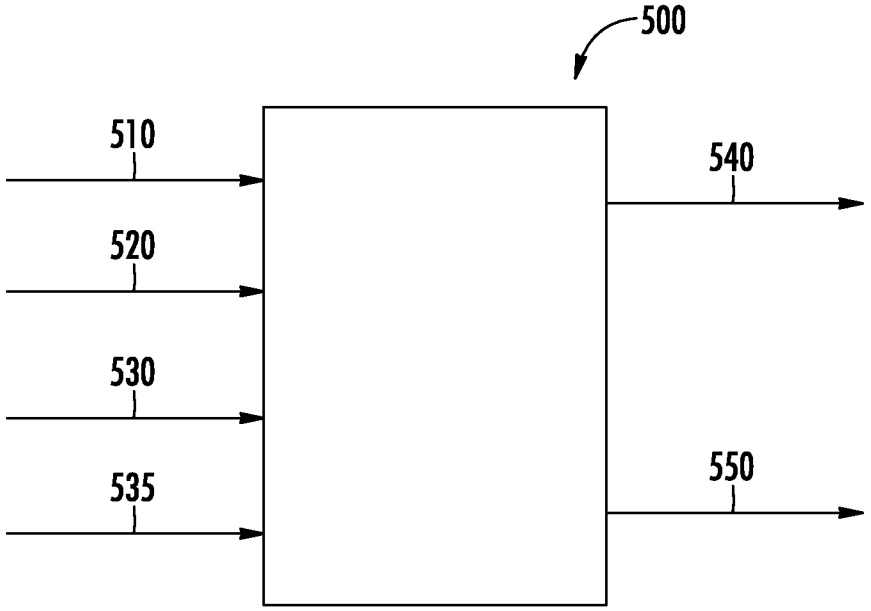
FIG. 5 shows a multi-input multi-output controller architecture (500) for the embodiments of FIGS. 4A and 4B.

FIG. 5 shows a multi-input multi-output controller architecture (500) for the embodiments of FIGS. 4A and 4B illustrating the controller inputs and outputs, for example, inputs: target manifold pressure (510); manifold pressure measurement (520); % travel (50); single point or filtered "tailpipe" pressure measurement (535); and outputs: velocity (540) and tank pressure set point (550).

Figure 6:
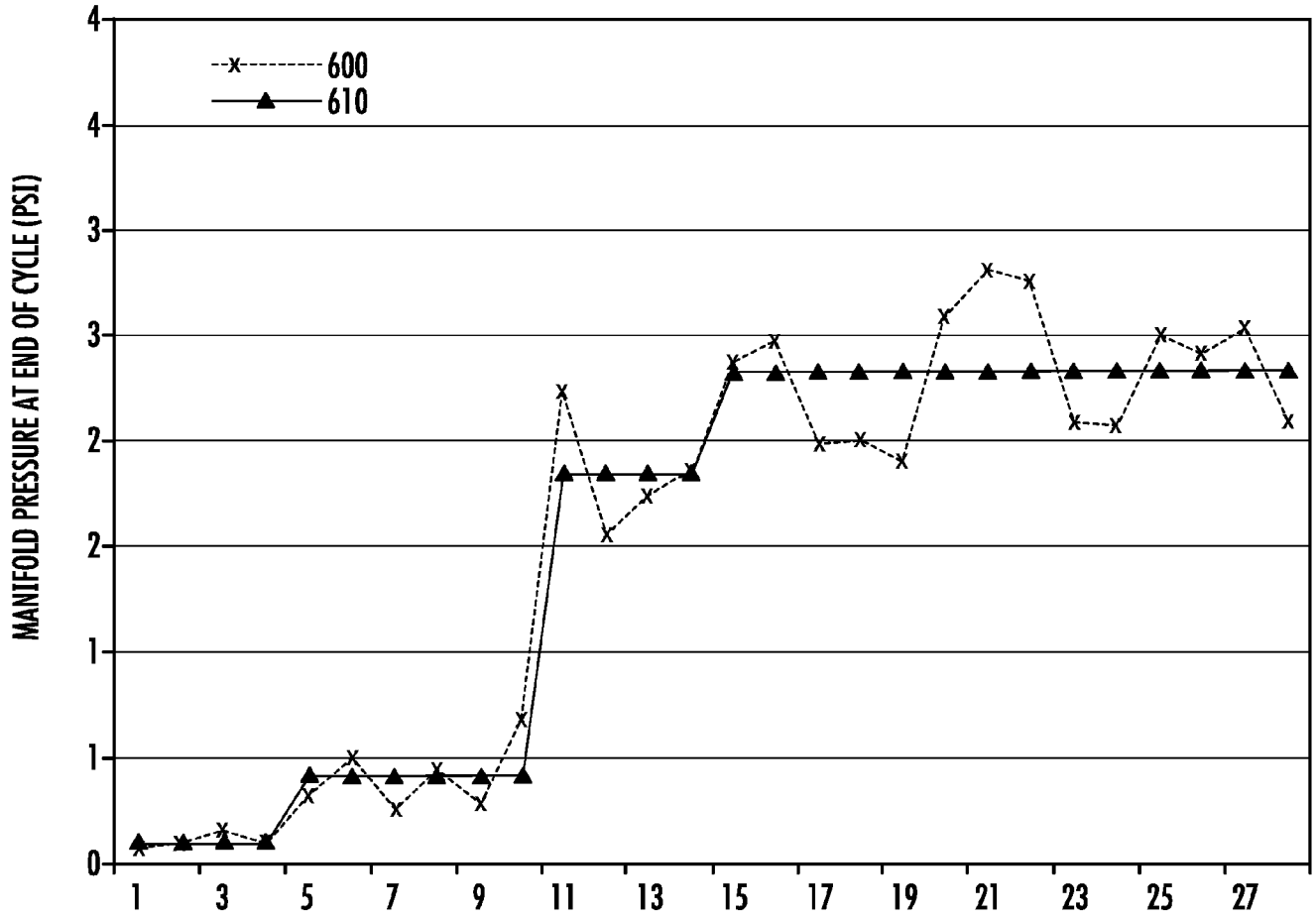
FIG. 6 shows a graph of sample validation results of a model used as part of the disclosed pseudo feed-forward control scheme where the manifold pressure at the end of a cycle (600), and model estimate (610) data are shown.

FIG. 6 shows a graph of sample validation results of a model used as part of a pseudo feed-forward control scheme where the manifold pressure at the end of a cycle (600), and model estimate (610) data are shown.

Figure 7:
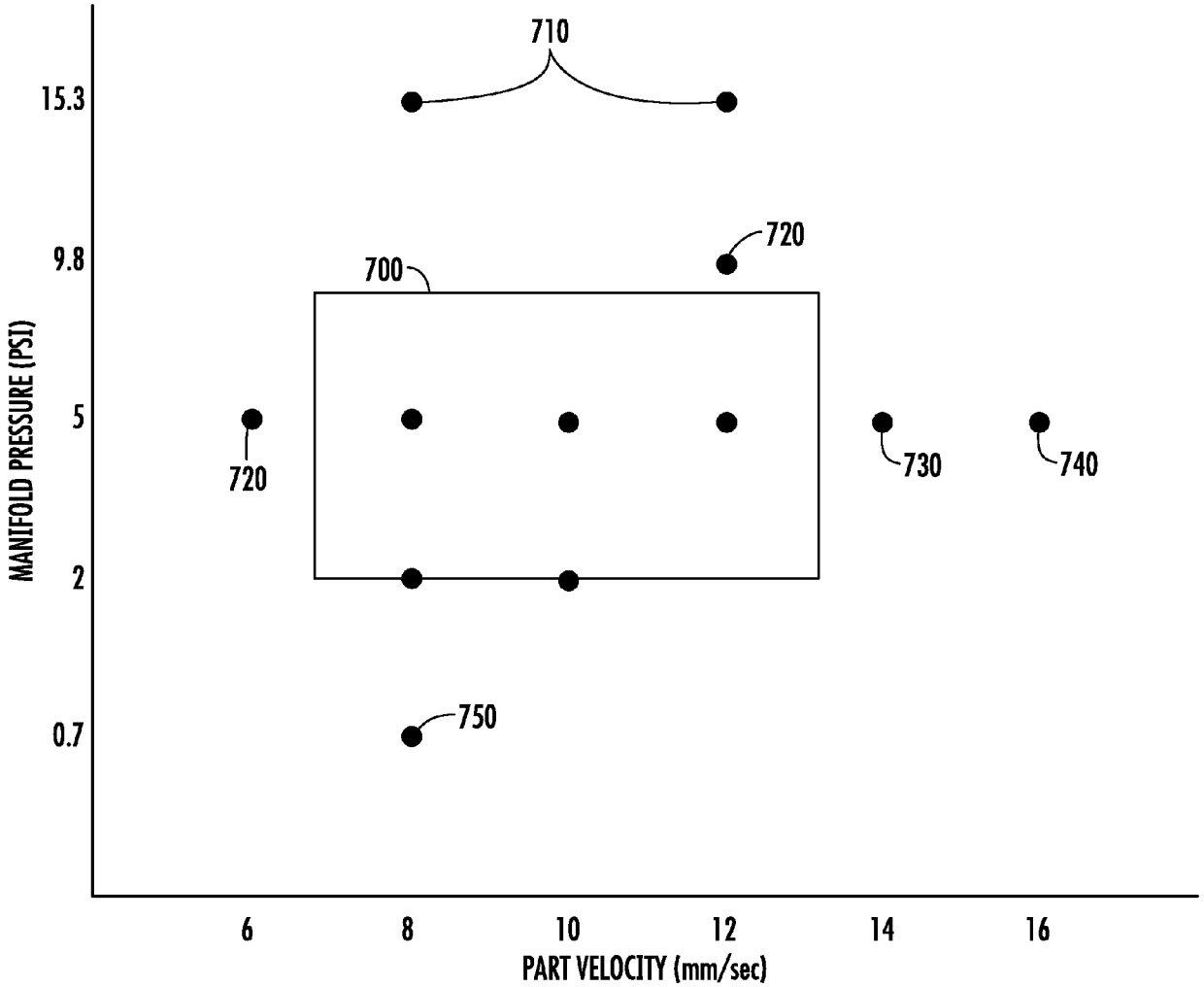
FIG. 7 is a graph of experimental results of manifold pressure (psi) as a function of part velocity that demonstrates a nominal or preferred operating process window (700).

FIG. 7 is a graph of experimental results of manifold pressure (psi) as a function of part velocity that demonstrates a nominal or preferred operating process window (700). The part skin quality results and trends for various operating conditions are identified as follows: fast flow (710), some fast flow (720), some starving (730), starving (740), and greater than 30% skinless part (750). Based on these experiments, it was found that the preferred operating process window with respect to the manifold pressure was from 3 psi to 8 psi and the skin velocity was from 7 mm/sec to 13 mm/sec.

Figures 8, 8A, 8B, 8C:
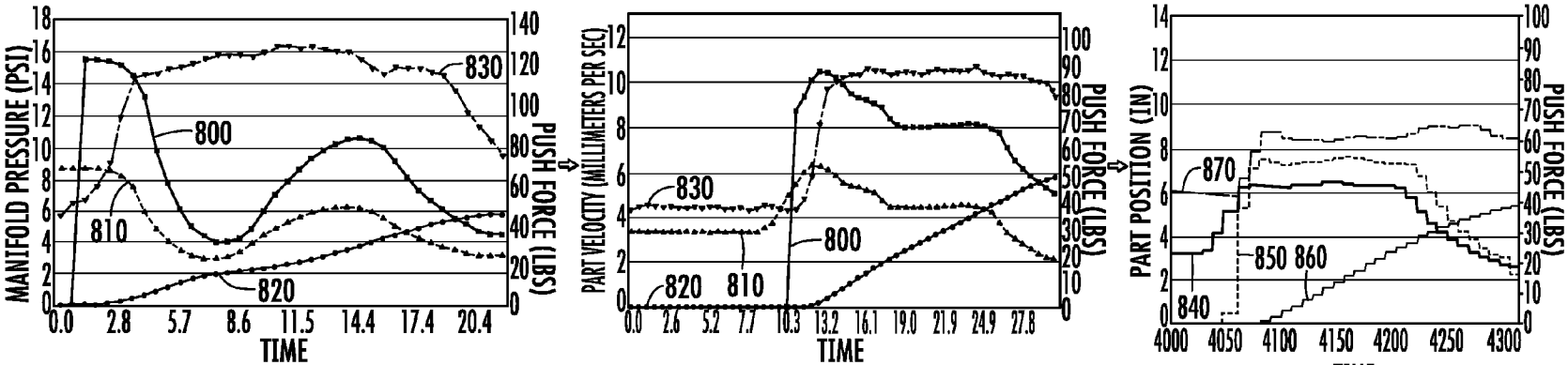
FIGS. 8A to 8C respectively show examples of the process: before the implementation of the disclosed control strategy (8A); the implementation of the disclosed control strategy (8B); and with a preferred refinement of the nominal skin velocity (8C).

FIGS. 8A to 8C respectively show examples of the process: before the implementation of the proposed optimized control strategy (8A) having many transients and very inconsistent and non-reproducible process; the implementation of the process control strategy (8B) having a more consistent and reproducible process which readily reaches steady state where the push velocity (800), the manifold pressure (810), the part location or position (820), and the push force (830) lines over time are shown; and with the optimization of the nominal skin velocity (8C) having a flat profile for significant parameters, and which process reaches steady state more quickly where the manifold pressure (840), the velocity in millimeters per second units (MMP sec) (850), the part position or location (860), and the push force (870) lines over time are shown. The disclosure provides a method of obtaining uniform, repeatable pressure and velocity profiles during axial skinning in an index push operation. The labels and unit for the vertical axes in FIGS. 8A to 8C are manifold pressure (psi); part velocity (millimeters per sec); and part position (in inches) (left side); and push force (in pounds) (right side).

Referring again to the figures, FIG. 1 shows a schematic of the axial skinning apparatus and process. The basic operation includes skin material being fed into the cylindrical applicator tube (also known as the "unipipe") through pipes from a pressure tank maintained at a constant pressure. The unipipe has holes or apertures designed around the center line or axis. The skin material from the tank goes through a manifold. The manifold has at least two functions: primarily distribute the cement flow from the tank uniformly around the unipipe, and secondarily provide structural support for the unipipe. Once the skin material is detected in the unipipe, the pusher pushes the part through the unipipe. As the part goes through the unipipe, skin material is applied onto the part and a skinned part comes out of the unipipe. The pusher can be electrically actuated.

FIGS. 2A and 2B shows schematics of embodiments of the axial skinning process control architecture. In these embodiments, the difference is the determination of the manifold pressure feedback. In embodiment FIG. 2A, the pressure at one location of the manifold exit (inlet to the unipipe) is monitored and used as feedback. The assumption here is that the skin material flow is uniform around the unipipe. In embodiment FIG. 2B, the pressure at two sides of the unipipe is measured. The pressure measurement is not restricted to only two locations around the unipipe, but could also include multiple locations around the unipipe that would give information pertaining to the uniformity of the skin material flow into the unipipe. This pressure at the manifold exit also gives information regarding whether there is enough skin material present in the manifold to apply skin to the part. This pressure feedback (either the single point or a filtered value) is used as an input to a multi-input multi output (MIMO) controller that also includes a target manifold pressure set point and the % of distance travelled (% Traveled) by a part inside the unipipe (obtained from the motor pushing the part through the unipipe) as additional inputs. The output of the proposed MIMO controller is the change in the part velocity that is needed to compensate for the error between the single point or filtered manifold pressure and target manifold pressure. Another output of the controller is the tank pressure set point, that is sent to the tank pressure controller, and that adjusts the air pressure to maintain the tank at the desired pressure.

FIG. 3 shows a schematic of the input and output of the controller. The governing equations for this MIMO controller are given by equation (1):

$$U_{FB}(k) = \begin{cases} \text{Velocity} & P_{Tank} & \text{Condition} \\ 0 & P_{Tank}^{SP} & P_{manifold} < P_{threshold}; \\ \Psi(e(k), U_{FB}(k-1)) & P_{Tank}^{SP} & P_{manifold} > P_{threshold}; \ \% \ Travel < \% \ Travel_{threshold} \\ \Psi(e(k), U_{FB}(k-1)) & y & P_{manifold} > P_{threshold}; \ \% \ Travel > \% \ Travel_{threshold} \end{cases} \quad (1)$$

where, '$U_{FB}$(k)' is the output of the controller at time instant, 'k', $P_{manifold}$ is either the single point manifold pressure or the filtered manifold pressure that is measured at the exit of the manifold, $P_{threshold}$ is a threshold that is used to determine when to actually start the skinning process, e(k) is the error between the measured manifold pressure and the manifold pressure set point, $P_{Tank}^{SP}$ is the set point of the tank pressure, and ψ(.), where ψ(.) is a function, having one or more possible inputs or variables, that computes the change in the velocity required to compensate for the error between the measured and target manifold pressure, and % Travel is defined as the % of distance travelled by the part inside the unipipe. For example, when $P_{manifold}$ or $P_{tailpipe}$ is greater than $P_{threshold}$ then the skinning process can be started. Similarly, when $P_{manifold}$ or $P_{tailpipe}$ is less than $P_{threshold}$ then the skinning process can be stopped.

Based on the open loop response of the system, it was observed that the relationship between the velocity and the manifold pressure is converse or inversely related. This means that if the velocity is increased, the manifold pressure decreases, and vice versa. In view of this relationship the error between the measured pressure and the target pressure is defined. If only a single point pressure is measured at the manifold exit, then the error, e(k) is defined as:

$$e(k)=P_{manifold}P_{manifold}^{SP} \quad (2)$$

If the pressure at the manifold exit is measured in multiple locations, then the error, e(k) is defined as:

$$e(k)=\Phi(P_{manifold})-P_{manifold}^{SP} \quad (3)$$

where, $P_{manifold}^{SP}$ is the target manifold pressure and the function, Φ(·) is the filter function, having one or more possible inputs or variables, that is applied to the different pressure measurements around the unipipe at the manifold exit. There are many options in choosing an optimum filtering function. However, one of the simplest forms of the function is the averaging filter function that is defined as:

$$P_{manifold}^{filtered} = \frac{1}{n}\sum_{i=1}^{n} P_{manifold}^{i} \quad (4)$$

where, n is the total number of pressure measurements taken around the unipipe at the manifold exit and $P_{manifold}^{i}$ is the manifold pressure at location, 'i' at the manifold exit around the unipipe. The function ψ(.) computes the change in the velocity required to compensate for the error between the measured and target manifold pressure. Again, there are many options in choosing an optimum function. A simplest form of the function is given by:

$$U_{FB}(k)=U_{FB}(k-1)-K_P[e(k)-e(k-1)]+TK_ie(k) \quad (5)$$

where, 'k' is the discrete time instant, T is the sampling time, $K_P$ and $K_I$ are the controller parameters determined using open loop response of the system. The initial value of $U_{FB}$(k−1) is the nominal velocity with which the part is pushed through the unipipe. The details around how the nominal velocity is chosen are described below.

As can be noted from equation (1), the controller action is different depending on certain conditions defined by the third column of equation (1). The threshold for the % Travel described by % $Travel_{threshold}$, the manifold pressure threshold given by $P_{Threshold}$, and the controller output for the tank pressure (y) are determined based on an understanding of process fundamentals and can be automatically determined using a pseudo feed-forward controller described below. These values will change depending on the properties of the flowable skin cement such as viscosity, water content, particle size distribution (PSD), and like considerations.

FIGS. 4A and 4B show schematics of the embodiments 4A and 4B of an axial skinning process control strategy. In these embodiments, the pressure at the bottom of the unipipe (also known as the tailpipe pressure) can be controlled to a target value. As stated in embodiments 2A and 2B, the number of sensors used to measure the tailpipe pressure distribution is dependent on the uniformity of skin material flow around the unipipe. The governing equations of the multi-input multi-output controller for embodiments 4A and 4B are given by equation (6):

$$U_{FB}(k) = \begin{cases} \text{Velocity} & P_{Tank} & \text{Condition} \\ 0 & P_{Tank}^{SP} & P_{manifold} < P_{threshold}; \\ \Theta(e'^{(k)}, U_{FB}(k-1)) & P_{Tank}^{SP} & P_{manifold} > P_{threshold}; \ \% \ Travel < \% \ Travel_{threshold} \\ \Theta(e'^{(k)}, U_{FB}(k-1)) & y & P_{manifold} > P_{threshold}; \ \% \ Travel > \% \ Travel_{threshold} \end{cases} \quad (6)$$

where, e'(k) is the error between the measured tailpipe pressure and the target tailpipe pressure at time instant, 'k' and the θ(.) is the function that computes the change in velocity required to compensate for the error between the measured tailpipe pressure and the target tailpipe pressure. In this instance, the relationship between the velocity and the tailpipe pressure is direct acting. Hence, taking this into consideration, if only a single point tailpipe pressure is measured, then the error, e'(k) is defined as:

$$e'(k)=P_{Tailpipe}^{SP}-P_{Tailpipe} \quad (7)$$

If the pressure at the tailpipe is measured at multiple locations, then the error, e'(k) is defined as:

$$e'(k)=P_{Tailpipe}^{SP}-\Phi(P_{Tailpipe}) \quad (8)$$

where, $P_{Tailpipe}^{SP}$ is the target tailpipe pressure and the function, Φ(.) is the same function that is defined in equation (3).

The function θ(.) computes the change in the velocity required to compensate for the error between the measured and target tailpipe pressure. Again, there are many options in choosing an preferred function. A simplest form of the function is given by equation (9):

$$U_{FB}(k)=U_{FB}(k-1)+K'_P[e'(k)-e'(k-1)]+TK'_Ie'(k) \quad (9)$$

where, 'k' is the discrete time instant, T is the sampling time, $K'_P$ and $K'_I$ are the controller parameters determined using open loop response of the system. As mentioned above, the initial value of $U_{FB}$(k−1) is the nominal velocity with which the part is pushed through the unipipe.

Also, note that the conditions for the controller action are still based on the manifold pressure even though the tailpipe pressure is used in the feedback control. This ensures that there is enough skin material present in the manifold before the skinning process starts.

"Pseudo" is used in describing the control scheme because in real-time, the output of the controller is used for the next part and does not impact the current part that is being acted on (pushed through the unipipe) by the axial skinning apparatus and method. In an ideal feed-forward control scheme, the control action is used for the existing part in real-time. The present disclosure is believed to be a demonstration of using the pseudo feed-forward control technique for a "batch" type or non-continuous process.

The basic premise of the disclosed controller is that it relies on the pressure in the manifold being sufficiently built before the part can be pushed through the unipipe. This build-up of manifold pressure is determined by comparing the measured manifold pressure to a threshold pressure, $P_{Threshold}$. Also, if the tank pressure is maintained at the target value for the entire duration of the cycle, then the skin quality is compromised and defects are seen on the final skinned product. Hence, the tank pressure has to be reduced to account for the excess skin material already present in the tubing and manifold such that there is just a sufficient amount of material present to skin the part without starving the part. Since the tank pressure is reduced and some of the skin material in the manifold and the tubing are used to skin the part, the pressure in the manifold reduces. Since before the start of the next cycle, the control action is not taken unless the manifold pressure is sufficiently high enough; it has to be ensured that at the end of the cycle, the manifold pressure drops significantly below the set threshold value given by $P_{Threshold}$. Hence, a balance between the time at which the tank pressure is reduced and the manifold pressure threshold need to be achieved to obtain preferred utilization of the skin material for significant cost savings. Hence, there are at least four variables that need to be considered: the tank pressure at the start of the cycle; the time at which the tank pressure should be reduced; the value to which the tank pressure should be reduced to; and the manifold pressure threshold.

To reduce the complexity of the algorithm, one of the variables, which is the value to which the tank pressure should be reduced to, is fixed at 0. Hence the problem reduces to determining a balance between three variables: the tank pressure at start of the cycle; the time at which the tank pressure is reduced; and the manifold pressure threshold such that at the end of the skinning cycle, the manifold pressure is significantly lower than the threshold value. The time at which the tank pressure is reduced to is converted from a time perspective to distance travelled by the part in the unipipe, which is defined as % Travel.

The first step in designing this pseudo feed-forward control is to develop a model between the key variables. First, a model between the tank pressure at the start of the cycle, % Travel, manifold pressure threshold value $P_{Threshold}$, and manifold pressure at the end of the skinning cycle given by $P_{manifold}^{at\ end\ of\ cycle}$ is developed:

$$P_{manifold}^{at\ end\ of\ cycle} = \Lambda\left[P_{Tank},\ \%\ Travel_{threshold},\ \frac{P_{threshold}}{P_{manifold}^{SP}} \times 100\right] \tag{10}$$

where, Λ(.) is a model function. This function could be a first principles-based model or a data driven model. One such example of a data driven model (empirical model) is given below:

$$P_{manifold}^{at\ end\ of\ cycle} = (K1 \times P_{Tank}) + (K2 \times \%\ Travel_{threshold}) + \left(K3 \times \frac{P_{threshold}}{P_{manifold}^{SP}} \times 100\right) + K4 \tag{11}$$

where, $P_{manifold}^{SP}$ is the manifold pressure set point and K1, K2, K3 and K4 are obtained using least-squares and are equal to "0.061", "0.0715", "0.0239" and "−6.697" respectively. However, if the tank pressure at the start of the cycle is held constant at 50 psi, the model reduces to:

$$P_{manifold}^{at\ end\ of\ cycle} = (K1' \times \%\ Travel_{threshold}) + \left(K2' \times \frac{P_{threshold}}{P_{manifold}^{SP}} \times 100\right) + K3' \tag{12}$$

where, K1', K2' and K3' are obtained using least squares and are equal to "0.0715", "0.0239", and "−3.647", respectively. Depending on the tank pressure set point, the model parameters, K1', K2', and K3', should be modified.

However, for the pseudo feed-forward control scheme, the developed model cannot be used as is. The inverse of this model given by equation (13) is desired for this purpose:

$$(\%\ \mathrm{Travel}_{threshold}, P_{threshold})_{subject\ to\ constraints} = \Lambda^{-1}[P_{Tank}, P_{manifold}^{at\ end\ of\ cycle}] \tag{13}$$

The above model is solved using numerical techniques and the constraints on the output values are as follows:

$$40\% < \%\ Travel_{threshold} < 90\% \tag{14}$$

$$0.5 < \frac{P_{threshold}}{P_{manifold}^{SP}} < 0.8 \tag{15}$$

Determination of the Nominal Skin Velocity

The nominal skin velocity is the initial condition of the term, $U_{FB}(k-1)$ in equations (5) and (9). This is a significant parameter that impacts the variability of the significant process parameters. The nominal skin velocity has to be optimum with regard to achieving defect free skinned parts. The skin velocity is highly dependent on the batch pressures. FIG. 7 shows a snapshot of the impact of different skin velocities and different manifold pressures on the final skin quality. The nominal process window depicted in FIG. 7 changes with part dimensions and batch properties.

FIG. 8 shows example charts of the reduction in the process parameter variability that is suitable for obtaining a defect free skinned part. FIG. 8A shows an example of one skinning cycle in which all the significant process variables have a high level of variability resulting in a very inconsistent and non-repeatable process. FIG. 8B shows the changes observed with the implementation of a preferred process control strategy in which the variability of the process variables are reduced significantly leading to a more consistent and more repeatable process. The disclosed control scheme also enables the process to reach steady-state within one skinning cycle as opposed to an earlier situation where the process never entirely reached a steady-state operating regime. FIG. 8C shows the changes observed in the nominal velocity was varied. This resulted in a flat profile for the significant process parameters and also aids in the process reaching steady-state sooner. It was observed that the lower variability in the significant process parameters within a skinning cycle resulted in reducing defects seen on the final skinned product.

EXAMPLES

The following example(s) serve to more fully describe the manner of using the above-described disclosure, and to further set forth the best modes contemplated for carrying out various aspects of the disclosure. It is understood that these examples do not limit the scope of this disclosure, but rather are presented for illustrative purposes. The working examples further describe how to accomplish the method of the disclosure.

Example 1

Process Control Steps for the Index Push Process

1. Enter selected process operating set points based on the previous run and the viscosity of the flowable cement batch: Tank pressure set point; Nominal skinning speed; $P_{threshold}$, and % $Travel_{threshold}$.
2. Load parts on to the skinner apparatus;
3. Wait for pressure to build-up in the manifold;
4. If the manifold pressure is greater than the threshold pressure value (i.e., $P_{manifold}>P_{threshold}$), then start the skinning process (i.e., move the parts through the skinner or move the skinner over a part). The part velocity and tank pressure profile are given in equation (1) or (6) above;
5. If the percent travel is greater than the percent travel threshold value (i.e., % Travel>% $Travel_{threshold}$) 1, then change the tank pressure set point to "y psi" (as given in equation (1) or (6)). For example, if the tank pressure set point was 50 psi to begin with, then if the % Travel condition is satisfied, the tank pressure set point can be changed to 0 psi;
6. Note the manifold pressure at the end of the skinning cycle (i.e., $P_{manifold}^{at\ end\ of\ cycle}$). This value should be below $P_{threshold}$. If not, use equations (13)-(15) to solve for the new $P_{threshold}$ and % $Travel_{threshold}$, and
7. Enter the new $P_{threshold}$ and % $Travel_{threshold}$ in the system and start the skinning cycle again.

The disclosure has been described with reference to various specific embodiments and techniques. However, it should be understood that many variations and modifications are possible while remaining within the scope of the disclosure.

What is claimed is:

1. A control system for an axial skinning apparatus comprising a tank for supplying a flowable cement to a manifold via tubing between the tank and the manifold, the manifold being configured to deliver the cement to a unipipe which is configured to apply the cement to an outer surface of a ceramic part, the control system comprising:

a combined feedback control and pseudo feed forward control controller which is configured to generate a tank pressure set point control parameter in response to a tank pressure of the cement in the tank, and in response to a manifold pressure of the cement in the manifold in comparison to a threshold pressure PThreshold.

2. The control system of claim 1 wherein the controller is configured to generate a tank pressure set point control parameter also in response to a real-time measurement of distance travelled as the part goes through the unipipe (% Travel) to determine nominal part velocity while traversing through the unipipe.

3. The control system of claim 1 wherein controller is configured to generate a tank pressure set point control parameter also in response to a unipipe exit pressure measurement.

4. A method of applying cement to first and second ceramic parts sequentially moved through a cylindrical tube, wherein the tube is attached to a manifold which feeds the cement from a tank to an outer surface of each part that passes through the cylindrical tube, the method comprising:

generating a tank pressure set point control parameter in response to a tank pressure of the cement in the tank for the first part;

remove the first part from the cylindrical tube;

allow pressure in the manifold to build up;

introduce the second part into the cylindrical tube when pressure in the manifold is greater than a threshold pressure value;

apply cement to the outer surface of the second part via combined feedback control and pseudo feed forward control.

5. The method of claim 4 wherein the tank pressure set point control parameter is also generated in response to a real-time measurement of distance travelled as the second part goes through the cylindrical tube (% Travel) to determine nominal part velocity while traversing through the cylindrical tube.

6. The method of claim 5 further comprising:

sensing a motive force acting on the cement;

sensing the % Travel of the ceramic honeycomb part traversing the cylindrical tube;

adjusting the motive force acting on the cement or adjusting a motive force acting on the part traversing the cylindrical tube based on the sensed motive force and the sensed % Travel.

7. The method of claim 4 wherein the tank pressure set point control parameter is generated also in response to a cylindrical tube exit pressure measurement.

8. The method of claim 4 wherein the first and second parts are skinned in a non-continuous, batch or stepwise manner using an indexed push dispense sequence.

* * * * *